United States Patent [19]

Minkkinen et al.

[11] Patent Number: 4,844,692

[45] Date of Patent: Jul. 4, 1989

[54] CONTOURED STEP ENTRY ROTOR CASING

[75] Inventors: George Minkkinen, Fairfield; Hans Drenkard, Stratford, both of Conn.

[73] Assignee: Avco Corporation, Providence, R.I.

[21] Appl. No.: 231,896

[22] Filed: Aug. 12, 1988

[51] Int. Cl.[4] ..... F04D 29/44

[52] U.S. Cl. ..... 415/208.1; 415/220; 415/914

[58] Field of Search ..... 415/DIG. 1, 182, 183, 415/170 R, 172 A, 216, 208, 209, 210

[56] References Cited

U.S. PATENT DOCUMENTS

| | | | |
|---|---|---|---|
| 1,554,052 | 9/1925 | Weidehoff | 415/172 A |
| 2,566,525 | 9/1951 | Kort | 415/DIG. 1 |
| 2,650,752 | 9/1953 | Hoadley | 415/DIG. 1 |
| 2,735,612 | 2/1956 | Hausmann | 415/DIG. 1 |
| 4,311,431 | 1/1982 | Barbeau | 415/172 A |
| 4,606,699 | 8/1986 | Hemsworth | 415/170 R |
| 4,645,417 | 2/1987 | Wisler | 415/170 R |
| 4,662,820 | 5/1987 | Sasada et al. | 415/170 R |

FOREIGN PATENT DOCUMENTS

| | | | |
|---|---|---|---|
| 56971 | 11/1939 | Denmark . | |
| 69404 | 6/1981 | Japan | 415/DIG. 1 |
| 1364511 | 8/1974 | United Kingdom . | |

OTHER PUBLICATIONS

NASA Technical Paper 1032 "Cold-Air Performance of a 12.766-Centimeter-Tip-Diameter Axial-Flow Cooled Turbine", by Haas and Kofskey, Sep. 1977.

*Primary Examiner*—Robert E. Garrett
*Assistant Examiner*—John T. Kwon
*Attorney, Agent, or Firm*—Perman & Green

[57] ABSTRACT

A gas turbine engine having a turbine casing with a contoured entry. The contoured entry is located upon the housing such that upon assembly of the engine the contoured entry is located relatively directly prior to the turbine blades. The contoured entry is positioned relatively directly prior to a spacing between the tips of the turbine blades and the housing such that gases are directionally restricted away from the spacing and into the turbine blades.

11 Claims, 2 Drawing Sheets

CONTOURED STEP ENTRY ROTOR CASING

BACKGROUND OF THE INVENTION

1. Field of the Invention

The present invention relates to gas turbine engines and, in particular, to a gas turbine engine having a rotor casing with a contoured step entry to a turbine wheel.

2. Prior Art .

The efficiency of a turbine section in a gas turbine engine is generally determined by how effectively the turbine can convert the kinetic energy from the hot gases exiting the combustors into shaft horsepower. In the past, maximum turbine efficiency required minimum clearance between the rotating blade tips and the rotor casing surrounding the turbine blades and vanes. If, however, the clearance between the blade tips and the casing was too tight, there was a potential of interference between the two, whereas, if the clearance was too wide, a loss of efficiency resulted by flow of the gases between the blade tips and the casing rather than impacting upon the turbine blades.

In one type of procedure used in the prior art, the casing was provided with a trench into which the tips of the blades would extend. In yet another method, as disclosed by U.S. Pat. No. 1,554,052 by Weidehoff, covers were used between vanes and blades to prevent fluid from bypassing the blades. In yet another method, as disclosed by U.S. Pat. No. 4,311,431 by Barbeau, labyrinth seals are positioned between static shrouds and rotating shrouds on the blades to reduce the leakage of hot gases through the shroud clearance space. Also disclosed by Barbeau is the use of compressed air as a thermal energy loss barrier.

A problem arises in presently available gas turbine engines in that energy is lost in the turbine section of the engines because of flow bypass through the area between the blade tips and turbine case.

A further problem arises in presently available gas turbine engines in that performance efficiency is too sensitive to tip clearance with the rotor casing.

A further problem arises in presently available gas turbine engines in that overall size reduction of gas turbine engines have increased the proportion of turbine efficiency loss due to tip clearance.

SUMMARY OF THE INVENTION

The foregoing problems are overcome and other advantages are provided by a turbine casing for use in a gas turbine engine. The turbine casing includes a contoured entry means for directing gases away from a spacing between the blade tips and the casing.

In accordance with one embodiment of the invention, the turbine casing comprises a housing for encasing the turbine section of the engine. The housing forms a portion of the gas flow conduit for guiding the gases from the combustors through the turbine section. The turbine blades have peripheral tips which are in close proximity to the housing with a spacing therebetween. A contoured entry is mounted on the housing for positioning in the gas flow path in the turbine section. The contoured entry is located relatively directly prior to the spacing between the housing and the blade tips and restricts the area of the gas flow path and accelerates the gases relatively immediately prior to the turbine blades such that the gases are directionally restricted away from the spacing and into the turbine blades whereby the gases substantially impact the turbine blades without directly passing between the housing and the blade tips.

In accordance with one method of the invention, gases are directed through the gas flow pathway in a turbine section towards the turbine blades. The gases are directionally guided away from the spacing between the tips of the turbine blades and the casing housing by a contoured entry means. The gases are also accelerated relatively immediately prior to the turbine blades by decreasing the cross-sectional area of the gas flow path and thereby imparting a greater force on the turbine blades.

BRIEF DESCRIPTION OF THE DRAWINGS

The foregoing aspects and other features of the invention are explained in the following description, taken in connection with the accompanying drawings where.

DETAILED DESCRIPTION OF THE INVENTION

Figure 1:
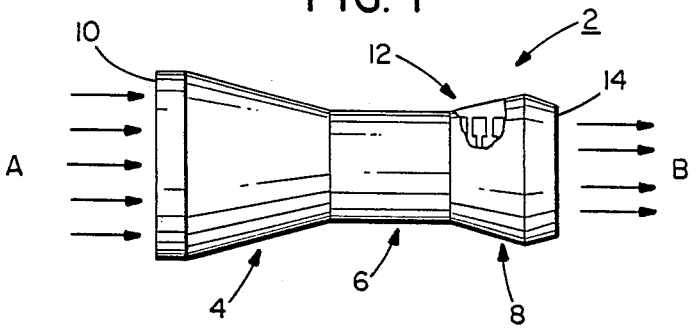
FIG. 1 is a diagrammatical view of a gas turbine engine.

Referring to FIG. 1, a gas turbine engine 2 is shown. The gas turbine engine of FIG. 1 is merely shown as a representational apparatus in which the present invention is employed. It should be understood that a contoured entry rotor casing of the present invention is intended for use in all turbine apparatus.

The engine 2 in FIG. 1 generally has three main sections; an air compressor section 4, a combustion section 6 and a driving turbine section 8. The air compressor section 4 takes in air at the inlet 10 as shown by flow arrows A and compresses the air for introduction into the combustion section 6. The combustion section 6 has several combustors or combustion apparatus (not shown). Air is directed into these combustors with fuel also being introduced and mixed with the air to provide an appropriate mixture for efficient combustion. Spent fuel, the heat product from combustion and additional cooling air are then forced into the driving turbine section 8 and exit at the exhaust portion 14 of the engine 2 as shown by flow arrows B. Located within the turbine section 8 is an axial flow turbine 12 having at least one stage.

Figure 2:
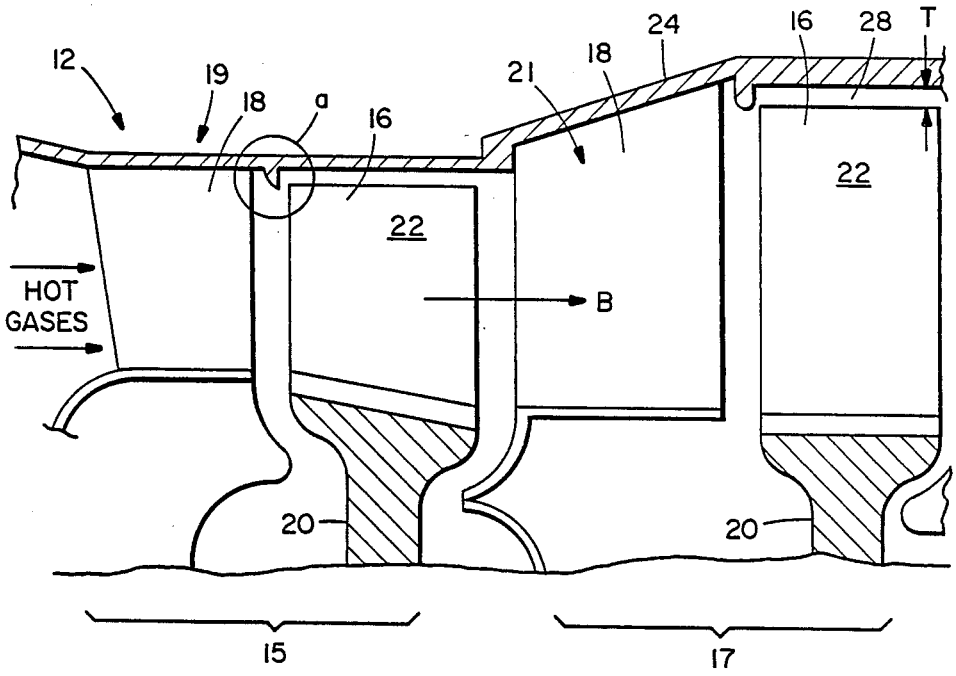
FIG. 2 is an enlarged cross-sectional diagrammatical view of a portion of a turbine section of the engine in FIG. 1.

Referring now to FIG. 2, an enlarged view of a portion of the turbine 12 of FIG. 1 is shown. The turbine 12, in this embodiment, has two stages 15 and 17. Each stage 15 and 17 comprise two main gas flow interaction members; a turbine wheel 16 having a set of turbine blades 22 mounted on a turbine disk 20 and a set of stationary stator vanes 18. The turbine 12 extracts kinetic energy from the expanding gases coming from the combustion section 6 and converts the energy into shaft horsepower to drive the compressor section 4 and engine accessories (not shown).

The stationary vanes or stator vanes 18 in the first and second stages 15 and 17 are arranged in a concentric ring-like position about the center axis of the turbine 12 in a gas flow path B. The vanes 18 are generally contoured and set at an angle to form a series of small nozzles. The vanes 18 redirect the combustion gases into the turbine blades 22 for efficient energy conversion. As the gases originally enter the turbine 12 they are directionally guided by the vanes 18 in the first stage 15. The vanes 18 turn the gas flow such that the gases will impinge upon the turbine blades in a proper direction to allow a large component force in the plane of the wheel 16. As with any nozzle, when the flow area is restricted, the gases will accelerate and a large portion of the static pressure in the gases is turned into dynamic pressure.

The turbine wheels 16, as discussed above, generally comprise disks 20 and blades 22. The blades 22 are generally mounted on the disks 20 in a ring-like position about the center axis of the turbine 12. The disks 20 are in turn mounted to a shaft (not shown) such that movement of the blades 22 about their ring-like position causes the shaft (not shown) to revolve about its center axis via the disks 20. The blades 22 are generally contoured to cause the gases to impart a greater force on the blades 22 and to deliver the gases to the second stage 17 stator vanes 18.

As the gases impact upon the blades 22 impulse and reaction forces cause the blades 22 to move in the direction of the plane of their wheel 16. The movement of the blades 22 is allowed by the spinning rotation of the disk 20 about the drive shaft center axis (not shown). In the embodiment shown, the second stage 17 is located behind the first stage. Therefore, as the gases exit the turbine blades 22 of the first stage 15, the gases impact upon the stator vanes in the second stage 17. The process of directing the gases via the stator vanes and extracting energy from the gases via the turbine blades is then repeated for each stage in the turbine section 8. However, as will be seen below, the present invention may also be used with a single stage turbine.

In order to controllably allow the gases from the combustion section 4 to expand and in order to efficiently extract the energy from the gases necessary to drive the shaft (not shown), the predetermined gas flow path B is provided in the turbine section 8. Located within the flow path B, as described above, are the stator vanes 18 and turbine blades 22. The flow path can best be described as a ring-like conduit having an outer boundary formed by a turbine casing 24 and an inner boundary formed by various elements such as the rotors 20, bottom ends of the stator vane assembly and pressurized cooling air entering into the flow path via gaps between the blades and vanes.

The casing 24 is generally made of any suitable material and generally surrounds the vanes 18 and wheels 16 in the first and second stage 15 and 17. The stator vanes 18 are generally attached to the interior of the casing 24. Because the wheels 16 are rotationally movable within the casing 24 and the casing 24 and vanes 18 are relatively stationary, suitable clearances are provided in the turbine section 8 for non-interference. In particular, a gap or spacing T is located between tips or outer peripheral ends 28 of the blades 22 and the rotor casing 24.

Figure 3:
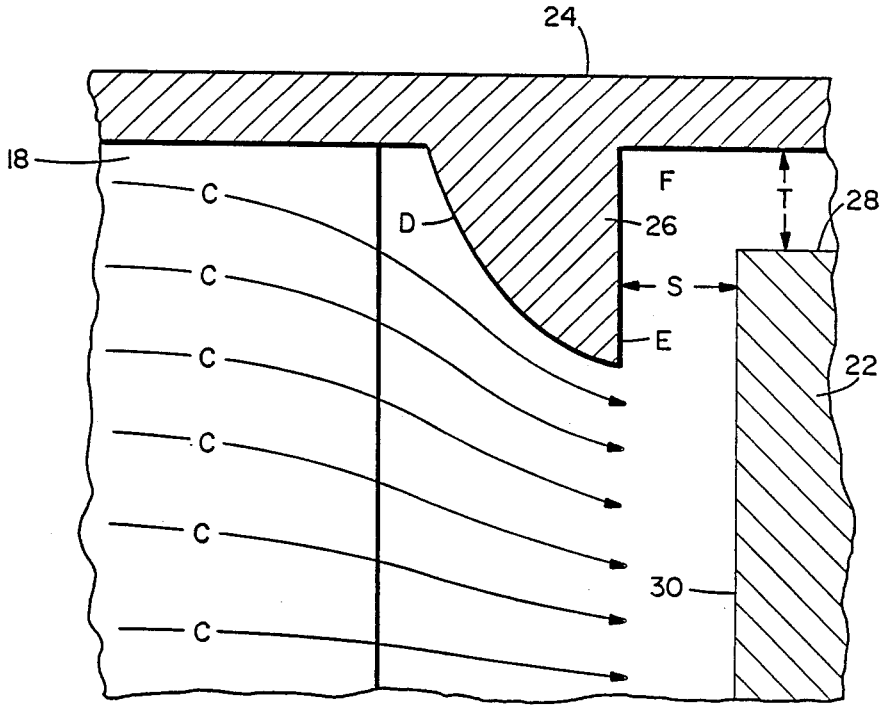
FIG. 3 is an enlarged cross-sectional view of a section a in FIG. 2.

Referring now to FIG. 3, an enlarged view of section a in FIG. 2 is shown. Also shown in this figure are representative flow lines C signifying the flow of the gases between the stator vanes 18 and the blades 22 adjacent the casing 24. As shown in this embodiment, located with the casing 24, between the vanes 18 and blades 22 is a protrusion 26 which extends into the flow path B of the gases. In the embodiment shown, the protrusion 26 generally consists of a two sided member which generally extends around the entire inner diameter of the casing 24. A first side D of the protrusion 26, located opposite the vane 18, has a relatively contoured or curved surface. A second side E, located opposite the blade 22, has a relatively flat surface approximately perpendicular to the casing 24 such that the second surface E is substantially parallel to a leading edge 30 of the blade 22. The second surface E is also set off or separated from the leading edge 30 of the blade 22 by a distance S.

As shown in this embodiment, the protrusion 26 is located relatively directly prior to the spacing T between the blade tip 28 and the casing 24. Since the protrusion 26 is located in the gas flow path B prior to the blade 22, the protrusion 26 acts as a step entry before the gases reach the blade 22. The entry 26 is generally shaped and located such that the gases flowing from the stator vane 18 to the blade 22 are aerodynamically directionally restricted away from the spacing T and into the turbine blade 22. Therefore, a majority of the gases which would otherwise flow through the path of least resistance, i.e.: the spacing T, are prevented from directly passing between the blade tip 28 and casing 24 thereby causing a loss in energy and inefficiency. The present invention, on the other hand, forces a majority of the gases to impact upon the blades 22 without directly passing between the casing 24 and the blade tips 28.

In addition to the features described above, because the entry 26 extends into the flow path B of the gases, the cross-sectional area of the flow path B at the entry 26 is restricted relatively immediately prior to the turbine blade 22. As with any fluid, by restricting the cross-sectional area of flow, the gases accelerate or increase velocity immediately prior to their impact upon the blade 22. This increased velocity of the gases relatively immediately prior to the blade 22, in addition to the decrease in losses due to tip 28 bypass, causes a greater force on the turbine blade 22 and, therefore, more efficient conversion of the kinetic energy of the gases to shaft horsepower.

Another feature of the present invention is the aerodynamically created dead zone F. The dead zone F is an area of open space located behind the entry 27 adjacent the second surface E. The dead zone F is an area where, because of the properties of fluids and the barrier to the gases which the entry 26 creates, the flow of the gases through this area is relatively small and slow when compared to the main flow of the gases between the vane 18 and blade 22. The dead zone F thus creates an area of relatively slow and small flow to prevent large amounts of the gases from otherwise quickly passing between the entry 26 and blade 22 through gap S and into the gap T.

The exact size, shape and position of the entry 26 can also obviously vary in various embodiments of the invention. The contour of the first side D may be generally curved or sloped. However, the precise curve or shape of the first side D should be chosen to maximize the aerodynamic properties of the entry 26 to present the least amount of resistance to the flow of gases, but nonetheless accomplishing the features described above.

The entry 26 is also separated from the blades 22 by the distance S such that no interference will be encountered between the blades 22 and the entry 26. In addition, unlike the trenched casing in the prior art, because the protrusion entry is used, no problems are encountered by interference from a portion of the casing that would otherwise be adjacent trailing edges of the blades 22. The gases by use of the present invention flow substantially directly into the blades 22 thereby reducing performance sensitivity to the blade clearance T. Incorporation of the present invention into current gas turbine engine designs involves the modification of only a single structure; the casing 24. The present invention, therefore, allows the application of the invention to be indepedent of the stator vane assemblies and the basic flowpath shape. In addition, incorporation of the present invention will also be relatively easy in non-cylindrical casing applications.

It should be understood that the foregoing description is only illustrative of the invention. Various alternatives and modifications can be devised by those skilled in the art without departing from the spirit of the invention. Accordingly, the present invention is intended to embrace al 1 such alternatives, modifications and variances which fall within the scope of the appended claims.

What is claimed is:

1. A turbine casing for use in a gas turbine engine, the gas turbine engine having a turbine section comprising stator vanes and a turbine wheel having turbine blades with first ends connected to a drive shaft and peripheral second ends, the turbine blades being located in a gas flow path for rotational movement by the gases to drive the drive shaft; the turbine casing comprising:

housing means for encasing said turbine section, said housing means forming a portion of a gas flow path conduit for guiding the gases in said turbine section and for proximal relationship with the blade second ends; and contoured ~~entry~~ means mounted on said housing means being adapted to be positioned in the gas flow path, said contoured entry means being adapted for projecting into a space between the trailing edges of stator vanes and the leading edges of blades relatively directly prior to a gap spacing between said housing means and the blade second ends to thereby restrict the area of the gas flow path to accelerate the gases relatively immediately prior to the turbine blades such that the gases are directionally restricted away from said gap spacing and into the turbine blades whereby the gases substantially impact upon the turbine blades without directly passing between said housing means and the blade second ends to thereby impart a greater force on the turbine blades.

2. A turbine casing as in Claim 1 further comprising turbine stator vanes connected to said housing means relatively directly prior to said contoured entry means.

3. A turbine casing as in Claim 1 wherein said contoured entry means has a curved flow surface.

4. A turbine casing as in Claim 1 wherein said turbine section has a plurality of turbine wheels.

5. A turbine casing as in Claim 4 wherein the turbine casing has a plurality of contoured entry means with each one of said contoured entry means associated with a respective turbine wheel.

6. A turbine casing as in Claim 5 wherein said turbine casing has a plurality of stator vane wheels, each one of said stator vane wheels being located relatively immediately prior to respective contoured entry means.

7. A turbine casing as in Claim 1 wherein said contoured entry means extends into the gas flow path relatively past said blade second ends.

8. A turbine casing as in claim 1 wherein said contoured entry means extends into the gas flow path relatively equal with said blade second ends.

9. A turbine casing as in claim 1 wherein said contoured entry means guidingly funnels the gases into said turbine blades.

10. A turbine casing as in claim 1 wherein said contoured entry means has a first face for directing the gases away from said gap spacing and a second face for non-interference with said turbine blades.

11. A method of improving efficiency in a turbine section of a gas turbine engine, said turbine section comprising a drive shaft having turbine blades connected thereto for rotational movement therewith and a turbine casing therearound forming a poriton of a gas flow pathway, the turbine blades having peripheral portions located proximate said turbine casing with a gap spacing therebetween, the method comprising the steps of:

directing gases through said gas flow pathway towards said turbine blades;

directionally guiding a portion of said gases away from said gap spacing between said peripheral portions of said blades and said turbine casing relatively immediately prior to said gap spacing by means of a contoured entry means located in a space between the trailing edges of stator vanes and the leading edges of said turbine blades whereby said gases are substantially prevented from directly passing through said gap spacing; and decreasing the cross-sectional area of said gas flow path relatively immediately prior to said turbine blades to thereby accelerate the gases to thereby impart a greater force on said turbine blades.

* * * * *